US005746162A

United States Patent [19]

Hosoi et al.

[11] Patent Number: 5,746,162

[45] Date of Patent: May 5, 1998

[54] SHEET PROCESSING APPARATUS AND SHEET PROCESSING METHOD

[75] Inventors: Masatoshi Hosoi; Yoshihide Sugiyama, both of Okazaki; Mitsuru Ichikawa, Nishio; Norihisa Masamura, Mizunami, all of Japan

[73] Assignee: Ricoh Company, Ltd., Tokyo, Japan

[21] Appl. No.: 719,949

[22] Filed: Sep. 25, 1996

[30] Foreign Application Priority Data

Sep. 25, 1995 [JP] Japan ..... 7-246301
Aug. 26, 1996 [JP] Japan ..... 8-223788

[51] Int. Cl.[6] ..... B65H 39/10
[52] U.S. Cl. ..... 123/58.09
[58] Field of Search ..... 270/58.08, 58.09

[56] References Cited

U.S. PATENT DOCUMENTS 4,495,582 1/1985 Dessert et al. ..... 364/469
5,328,169 7/1994 Mandel ..... 271/290
5,390,910 2/1995 Mandel et al. ..... 271/296
5,461,469 10/1995 Farrell et al. ..... 270/53

*Primary Examiner*—David A. Okonsky
*Attorney, Agent, or Firm*—Oblon, Spivak, McClelland, Maier & Neustadt, P.C.

[57] ABSTRACT

A sheet processing apparatus for punching a sheet having a detachable punching unit for accomplishing wide varieties of combinations of punching conditions such as a number of the hole, diameter of the hole, and a position of the hole at a sheet. A sort of the punching unit which is mounted to the apparatus is recognized by a recognition device and one of a sheet conveying speed, a punching speed, and a punch operation timing is controlled by a controller in accordance with a condition predetermined for each sort of the punching unit which is recognized by the recognition device.

23 Claims, 12 Drawing Sheets

SHEET PROCESSING APPARATUS AND SHEET PROCESSING METHOD

BACKGROUND OF THE INVENTION

1. Field of the Invention

The present invention relates to a sheet processing apparatus provided with a punching unit for punching holes in a sheet and a control method for punching holes in the sheet.

2. Discussion of the Background

Sheet processing apparatuses having punching units for punching holes in a sheet have been proposed broadly. When punching holes in sheets, there are many types of combinations of punching conditions such as a diameter of the hole, a number of holes, and a position of the holes depending upon the needs of a user.

However, the conventional sheet processing apparatus generally has a limited number of combinations of the punching conditions and is not capable of performing all desired combinations of the punching conditions. In other words, the conventional sheet processing apparatus is not applicable for general-purpose use.

SUMMARY OF THE INVENTION

Accordingly, one object of the present invention is to provide an improved construction of a sheet processing apparatus having an exchangeable punching unit is proposed for accomplishing wide varieties of combination of a diameter of the holes, a number of the holes, and a position of the hole.

The invention includes a sheet processing apparatus including a punching unit, detachably mounted on the apparatus for punching a sheet which is conveyed thereto, a recognition device for recognizing the type of punching unit which is mounted on the apparatus, and a controller which controls a punching operation of the punching unit in accordance with a condition predetermined for each type of punching unit which is recognized by the recognizing device.

The controller further controls at least one of a sheet conveying speed, a punching speed of the punching unit and a punch operation timing of the punching unit to the sheet, depending upon the type of punching unit which is recognized by the recognition device.

The punching unit is provided with a punch and a die which rotate in opposite directions which are driven by a drive motor. In order to punch a predetermined position of the conveyed sheet passing through between the punch and the die, the drive motor rotates at a predetermined timing to drive the punch and the die in a contrary direction to each other, and the sheet is punched by fitting the punch to the die.

There is a stapling unit for stapling conveyed sheets and a warning indicator for indicating a warning to an operator. The above-mentioned controller determines whether or not the punching position to the sheet interferes with the stapling position according to the type of the punching unit recognized by the recognition device. If the punching position interferes with the stapling position, the controller indicates a warning using the warning indicator, inhibits the stapling operation of the stapling unit, or controls a slight movement of the stapling unit in a direction perpendicular to a sheet conveying direction so that the punching position does not interfere with the stapling position.

In accordance with yet another aspect of the present invention, the recognition device is brought to a state to recognize the type of punching unit from punching information such as at least one of a number of holes, the diameter of the holes, and the position of the holes when the punching unit is mounted on the apparatus.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
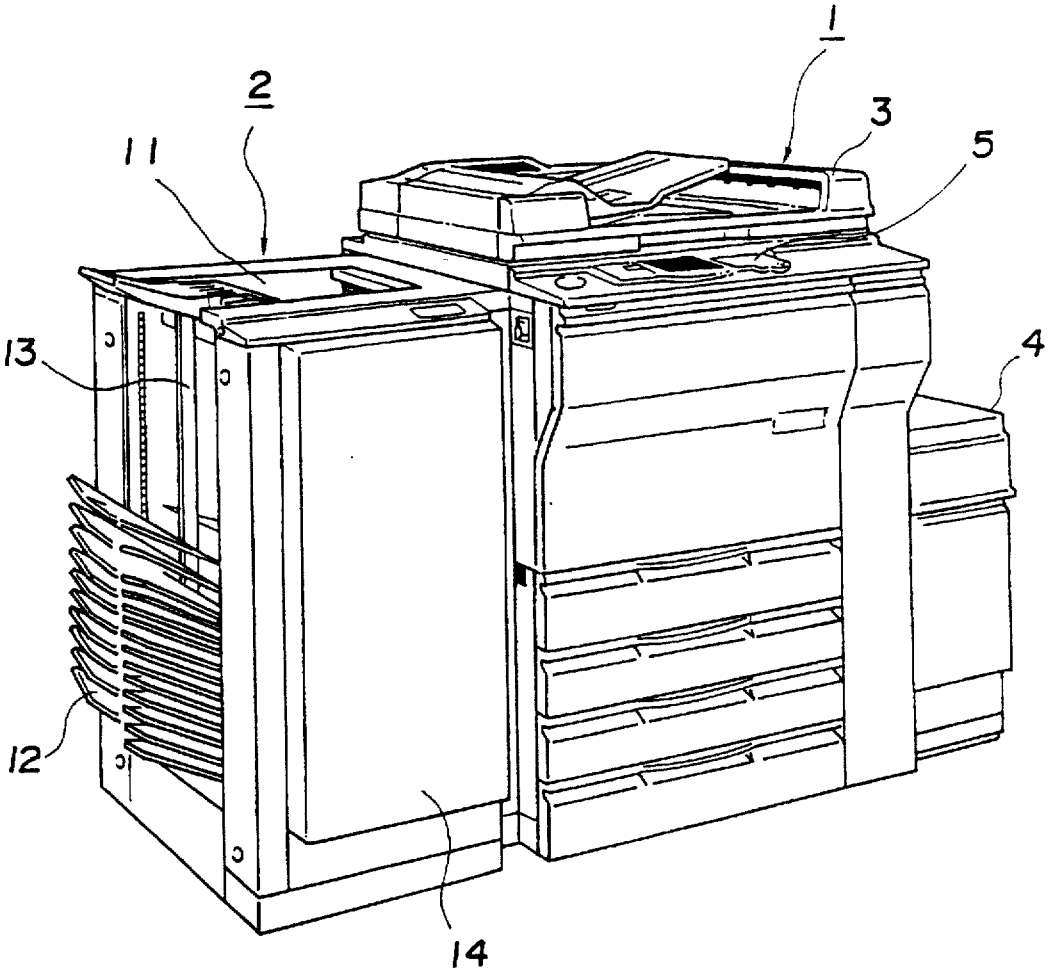
FIG. 1 is a perspective view showing a sheet processing apparatus.

Referring now to the drawings wherein like reference numerals designate like or corresponding parts throughout the several views and more particularly to FIG. 1 thereof, there is illustrated a sheet processing apparatus constructed according to the present invention. The sheet processing apparatus includes an image forming apparatus 1 and a sheet post-processing apparatus 2.

The image forming apparatus 1 is one of a reproduction machine, a printer, a facsimile machine, or a multiple function copier such as a digital copier/printer which can perform the functions of the previously listed device. The image forming apparatus 1 includes an automatic document feeder (hereinafter called ADF) 3, a large capacity paper feeding unit 4, and an operation unit 5 which is located at a front face of the apparatus. For example, the image forming apparatus 1 is a multiple function reproduction machine which reads image information of a document conveyed sequentially by the ADF 3 and forms the read image on a sheet, and is provided with functions of a printer, or a facsimile machine, that is, a function for forming an image of data from a computer, or data from a facsimile. A detailed construction of the image forming apparatus 1 is omitted in this embodiment as it is known.

The sheet post-processing apparatus 2 has functions such as sheet sorting, sheet aligning, sheet stapling, and sheet punching. The sheet post-processing apparatus 2 includes a proof tray 11, a plurality of bin trays 12, a jogger 13 for sheet aligning, and a front door 14.

Figure 2:
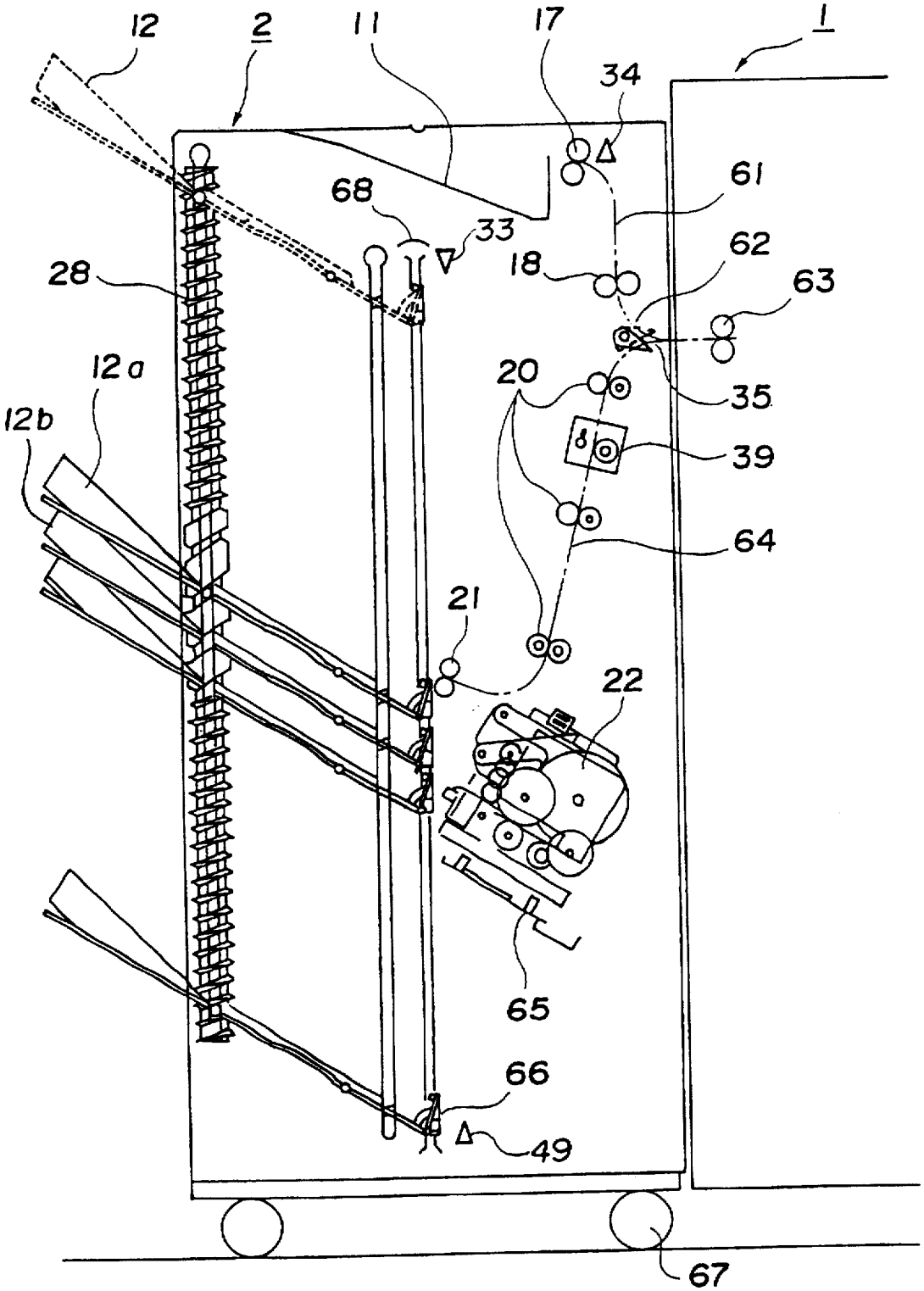
FIG. 2 illustrates a sheet post-processing apparatus.
Figure 3:
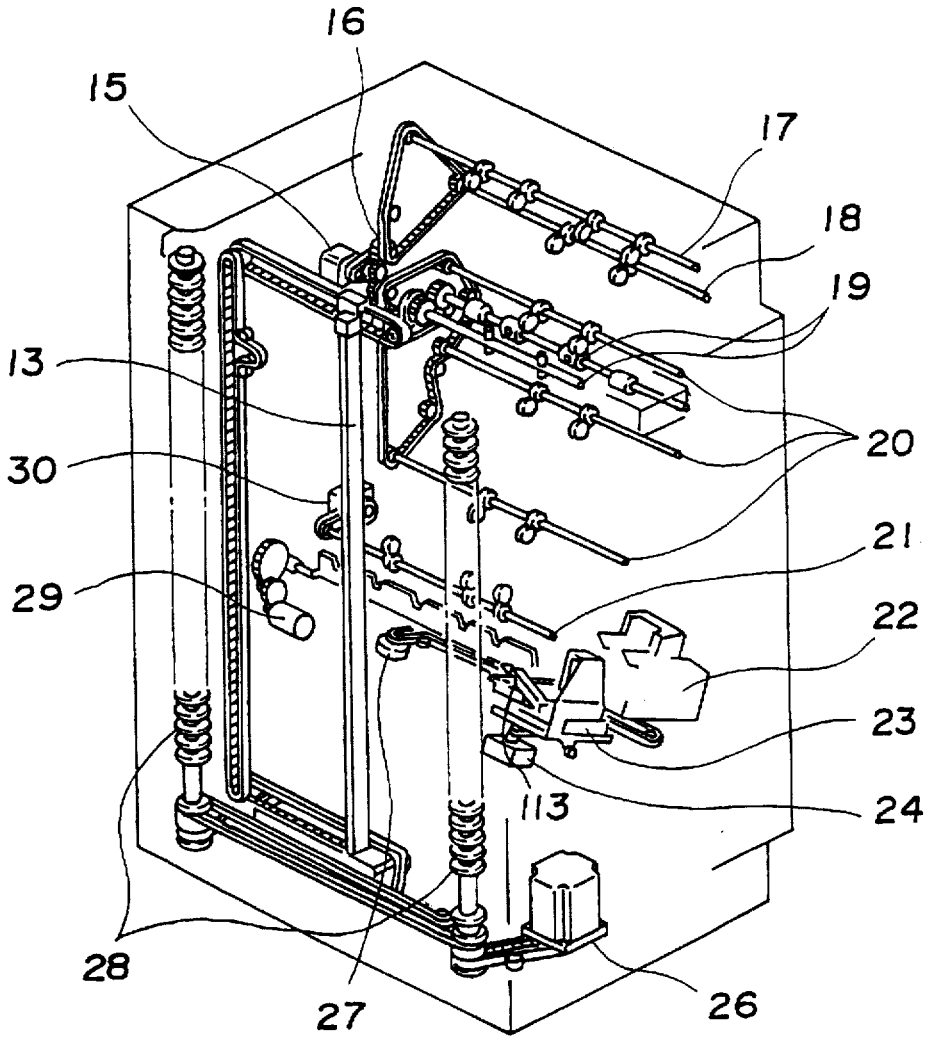
FIG. 3 is a perspective view showing a drive elements layout of the sheet post-processing apparatus.
Figure 4:
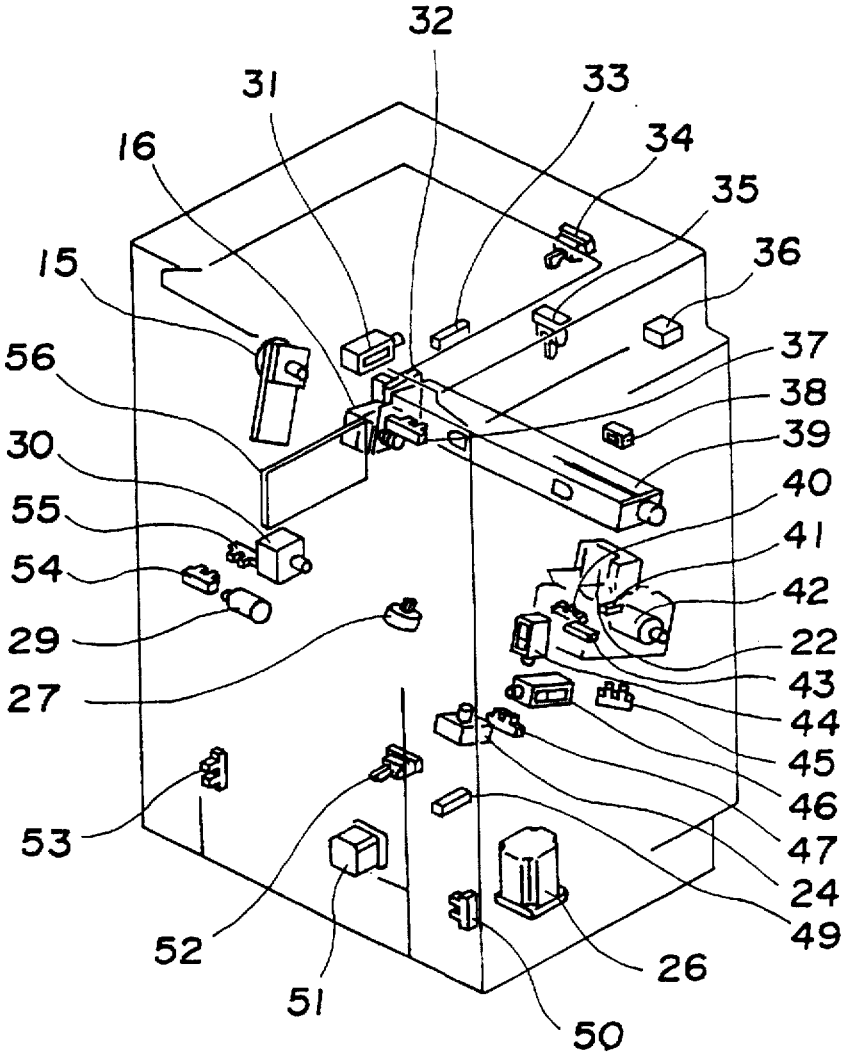
FIG. 4 is a perspective view showing an electrical component layout of the sheet post-processing apparatus.

FIG. 2 illustrates the sheet post-processing apparatus 2, FIG. 3 is a perspective view showing the drive elements layout of the sheet post-processing apparatus 2, and FIG. 4 is a perspective view showing the electrical component layout of the sheet post-processing apparatus 2. There are shown in FIG. 2, an entrance sensor 35, a selecting guide pick 62, a proof conveyer path 61, a proof conveyer roller 18, a proof discharging roller 17, a proof discharging sensor 34, a sorter conveyer path 64, a sorter conveyer roller 20, a punching unit 39, a bin discharging roller 21, an entry bin sensor light emitting part 33, an entry bin sensor light accepting part 49, a stapling unit 22, a helical cam shaft 28, a discharging roller 63 of the image forming apparatus 1, a slide rail 65, an end fence 66, a caster 67, and a stopper guide 68.

In FIG. 3, there is illustrated a sheet conveyer motor 15, a punching motor 16, a punching roller 19, a chucking unit 23, a chucking unit transferring motor 24, a bin lifting motor 26, a stapler transferring motor 27, an end fence releasing motor 29, and a bin discharging motor 30.

In FIG. 4, there are shown in addition to the aforementioned construction a selecting guide solenoid 31, a punching printed circuit board (punching PCB) 32, a door switch 36, a punch home sensor 37, a punch dust over flow sensor 38, a stapler home sensor 40, a needle end sensor 41, a stapler motor 42, a paper end sensor 43, a chuck solenoid 44 a slanting home sensor 45, a chuck transferring solenoid 46, a chuck home sensor 47, a bin pulse sensor 50, a jogger motor 51, a bin home sensor 52, a jogger home sensor 53, an open position sensor 54, a closed position sensor 55, and a main control board 56 for the sheet post-processing apparatus 2.

In the above-described construction, a sheet which is discharged from the discharging roller 63 of the image forming apparatus 1 to the sheet post-processing apparatus 2 is directed to a proof part or to a sort/stack part by changing the selecting guide pick 62 from the position drawn by a solid line to the position drawn by a broken line or vice versa as shown in FIG. 2. The sheet is discharged and stacked onto the proof tray 11 out of the sheet post-processing apparatus 2, through the proof conveyer path 61, the proof discharging roller 18, and the proof discharging roller 17, by changing the selecting guide pick 62 from the position drawn by the solid line to the position drawn by the broken line. The proof conveyer path 61 to the proof tray 11 is made as short as possible in order to make a first copy time short. The discharged sheets are stacked with the print facing up on a top of the sheet post-processing apparatus 2 in order for an operator to easily see images on the sheets and to pick up the sheets.

The sheet which is directed to the sort/stack part is discharged to the bin tray 12 through the sorter conveyer path 64, the sorter conveyer roller 20, and the bin discharging roller 21. The punching unit 39 is mounted along the sorter conveyer path 64 to punch holes in the sheet which is conveyed therethrough.

The lifting up and lowering down of the bin tray 12 stepwise in a vertical direction is controlled by an instructing signal from the controller of the image forming apparatus 1. The controller may be provided in the apparatus 1 or outside of the apparatus 1. A sort/stack mode selector for selecting a stacker mode and a sorter mode is placed at the operation unit 5 shown in FIG. 1. When the stacker mode is selected by the sort/stack mode selector, after discharging a predetermined number of sheets on which the same image information is formed, the bin tray 12 is lifted up or lowered down by turning on the bin lifting motor 26 and rotating the helical cam shaft 28 one time in accordance with an instructing signal from the controller of the image forming apparatus 1. When the sorter mode is selected by the sort/stack mode selector, the bin tray 12 is lifted up or lowered down in the same way after discharging one sheet in the bin tray 12. The lifting up and lowering down of the bin tray 12 and the selecting of the discharging bin tray 12 are instructed by a signal of the controller of the image forming apparatus 1.

The sheet which is discharged into the bin tray 12 is aligned by pushing the sheet in a direction perpendicular to the sheet discharging direction towards a side end of the bin tray 12 by the jogger 13, after a predetermined time after having been discharged into the bin tray 12. The sort/stack operation is completed by repeating the discharging of the sheet into the bin tray and alternately aligning the discharged sheets.

The completion of the sort/stack operation is instructed by the controller of the image forming apparatus 1. The sheet post-processing apparatus 2 stops the rotation of the sheet conveyer motor 15 and the bin discharging motor 30 by an instruction of the completion from the controller of the image forming apparatus 1, after the sheet discharging into the bin tray 12 is finished.

A punching mode selector such as a button or switch is provided in the operation unit 5 of the image forming apparatus 1 which is shown in FIG. 1. If the punching mode is selected by the punching mode selector, an instructing signal of the controller of the image forming apparatus 1 turns on the punching motor 16 when a tail end of the sheet passes out of the entrance sensor 35 and rotates a punch 171 and a die 172, which are described later, synchronizing with the sheet conveying speed, so that the sheets are punched one by one without stopping. The punch mode selector is provided at the operation unit 5 in this embodiment. However, it may be provided in the sheet post-processing apparatus 2.

The operation unit 5 of the image forming apparatus 1 is further provided with a stapling mode selector which is shown in FIG. 1 for selecting a stapling mode. When the stapling mode is selected by the stapling mode selector, the bin tray 12 in which the last sheet is discharged is moved to a stapling bin tray position **12*b* from a sheet discharging bin tray position 12*a*** after a sheet discharging and aligning operation of the sort/stack mode is finished.

In this embodiment, the sheet discharging bin tray position **12*a* is in a place adjacent to the stapling bin tray position 12*b*. After a last sheet is discharged, the bin tray 12 in the sheet discharging bin tray position 12*a* moves one bin downwards to the stapling bin tray position 12*b*. The jogger 13 is moved to the side end of the sheet in accordance with each sheet size each time when the movement of the bin tray 12 from the discharging bin tray position 12*a* to the stapling bin tray position 12*b* is finished so as to prevent a deviation of the sheets alignment due to a chucking operation of the chucking unit 23. A pair of chucking arms 113*a* and 113*b* are moved towards a set of the sheets (a direction perpendicular to the sheet discharging direction) by turning on the chuck transferring solenoid 46 after moving the jogger 13. After movement of the chucking arms 113***a* and 113*b* is finished, the set of the sheets is grasped by the chucking arms 113*a* and 113*b* by turning on the chucking solenoid 44. The jogger 13 returns to the home position after grasping the set of the sheets by the chucking arms 113*a* and 113*b* is completed.

The end fence 66 of the bin tray 12 is released by driving the end fence releasing motor 29 after the operation of grasping the sheets by the chucking arms 113*a* and 113*b* is completed. After the operation of releasing the end fence 66, the chucking unit transferring motor 24 is driven to move the chucking unit 23 towards the stapling unit 22 (the direction which the sheets come from), and transfers the set of the sheets to the stapling position.

After transferring the set of the sheets to the stapling position, the stapling unit 22 staples at a predetermined position on the set of the sheets according to the stapling mode which is selected via the stapling mode selector (not shown) by an operator. In this embodiment, there are four modes; a front position slanting (home position) mode, a front position mode, a rear position mode, and a two center positions mode.

After the stapling operation of the stapling unit 22 is finished, the chucking unit transferring motor 24 is driven in a contrary direction to the previous rotation to move back the chuck unit 23 to return the set of the stapled sheets to the previous position. A moving back distance of the set of the stapled sheets is slightly longer (about 1 mm longer in this embodiment) than the distance of moving forward so as to avoid the rear end of the sheets preventing the closing operation of the end fence 66. After the returning operation of the set of the stapled sheets is finished, the end fence 66 is closed by rotating the end fence releasing motor 29 in a reverse direction.

The chuck arms 113*a* and 113*b* are released by turning off the chuck solenoid 44 after the closing operation of the end fence 66 is finished. Then, the chuck transferring solenoid 46 is turned off, and the chuck arms 113*a* and 113*b* move back.

The chucking solenoid 44 is made to mechanically hold and not to release the chuck arms 113*a* and 113*b* which are grasping the sheet even when the power is shut off when the end fence 66 is not closed so as to prevent un-stapled sheets from being scattered in an internal space of the sheet post-processing apparatus 2 resulting from the chuck arms 66 to be released by power off due to opening of a front cover, or shutting off of the power source.

The series of stapling operations for the bin tray 12 in the stapling bin tray position 12*b* is thus finished. Then, the next bin tray 12 is moved upwards or downwards to the stapling bin tray position 12*b*, and the set of the sheets is stapled in the same way as mentioned above. The above-mentioned procedure is repeated until the stapling operation for each set of the sheets to be stapled finishes.

Figure 5:
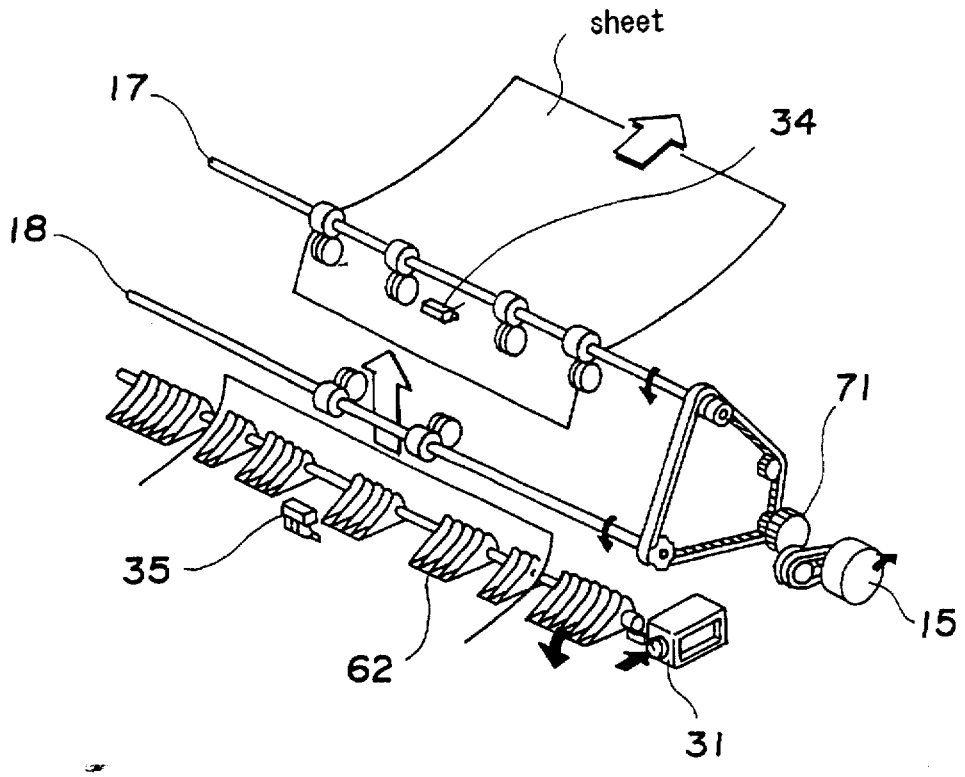
FIG. 5 is a perspective view showing a proof conveying part of the sheet post-processing apparatus from behind.

FIG. 5 is a perspective view from behind of the proof conveying part of the sheet post-processing apparatus 2. In the case of a proof mode, the sheet conveyer motor 15 is turned on for rotating in a clockwise direction, the selecting solenoid 31 is also turned on, and the sheet is conveyed from the image forming apparatus 1 to the proof discharging roller 17 through the proof conveyer path 61 by the proof conveyer roller 18, and discharged out towards the proof tray 11. An idler pulley 71 contains a one-way clutch so that only the proof conveyer roller 18 and the proof discharging roller 17 are driven in accordance with an instructing signal of the image forming apparatus 1.

Figure 6:
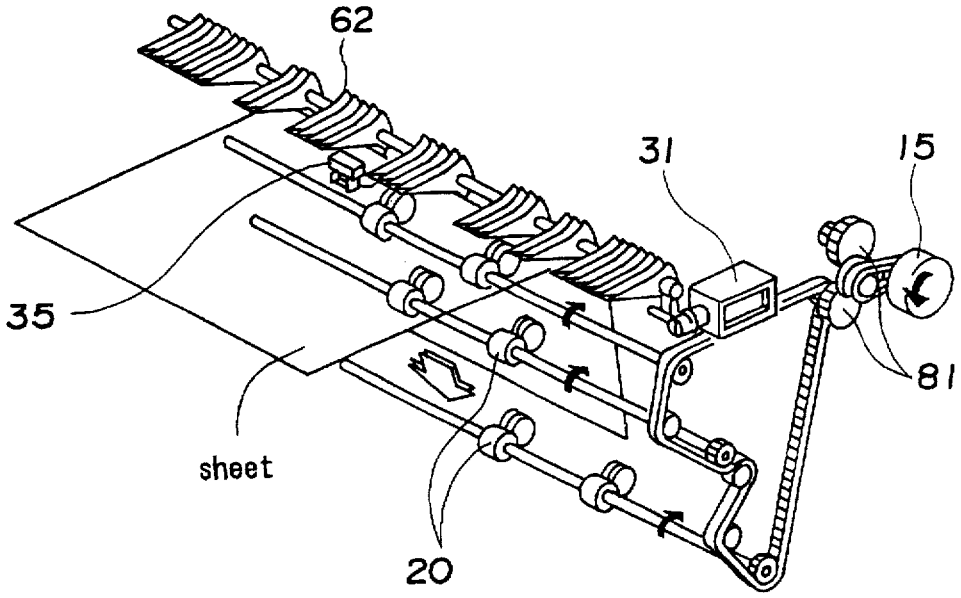
FIG. 6 is a perspective view showing a sort/stack conveyer part of the sheet post-processing apparatus from behind.
Figure 7:
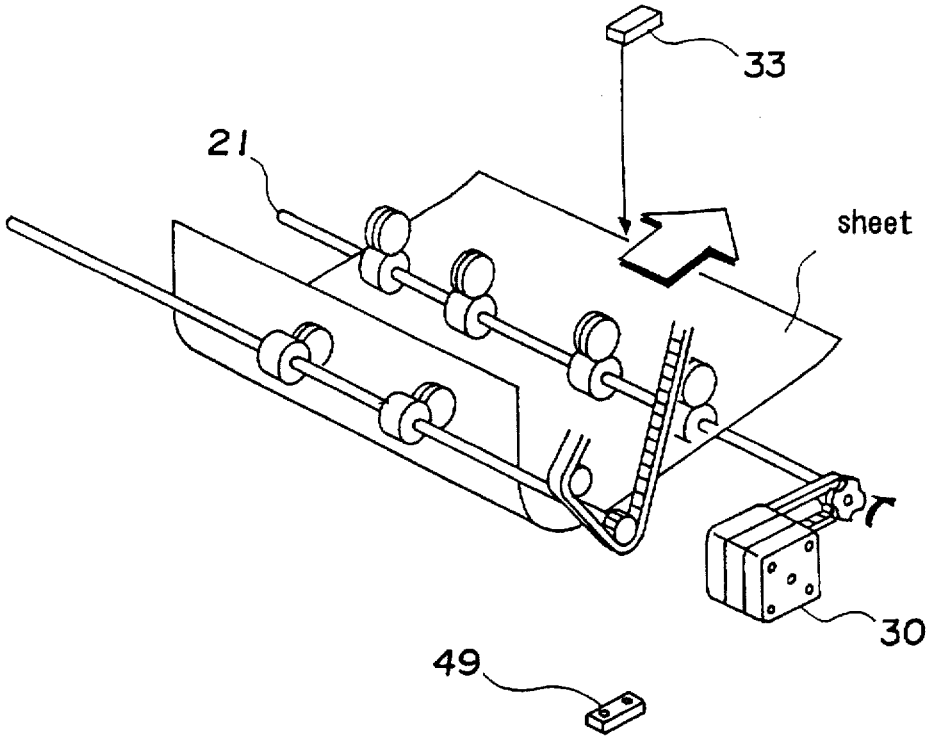
FIG. 7 is a perspective view showing a bin tray discharging section of the sheet post-processing apparatus from behind.

FIG. 6 is a perspective view of the sort/stack conveyer part of the sheet post-processing apparatus 2 from behind and FIG. 7 is a perspective view of the bin tray discharging section from behind. In the case of a sort/stack mode, the instructing signal of the image forming apparatus 1 rotates the reversible sheet conveyer motor 15 in a counterclockwise direction (contrary to the proof mode) as shown in FIG. 6, and the sorter conveyer roller 20 which is driven by the sheet conveyer motor 15 conveys the sheet which is discharged from the image forming apparatus 1 towards the bin discharging roller 21 through the sorter conveyer path 64.

An idler pulley 81 contains a one-way clutch as the idler pulley 71 of the proof part so that only the sheet conveying members in the sorter part are driven. Each of the proof part and the sort/stack part is driven independently by the changeover of a rotation (back and forth) of the sheet conveying motor 15 as explained above for the purpose of reducing of parts cost.

In addition, the sheet conveying speed of the sorter part is set slightly faster (e.g., 1–5% faster) than a sheet discharging speed of the discharging roller 63 of the image forming apparatus 1 by controlling the revolution speed of the sheet conveyer motor 15. However, the sheet conveying speed of the sorter part is not accelerated up to a high speed after the sheet leaves off from the discharging roller 63 of the image forming apparatus 1 as in the case of the proof mode, but is controlled to be a constant speed at all times.

Figure 8:
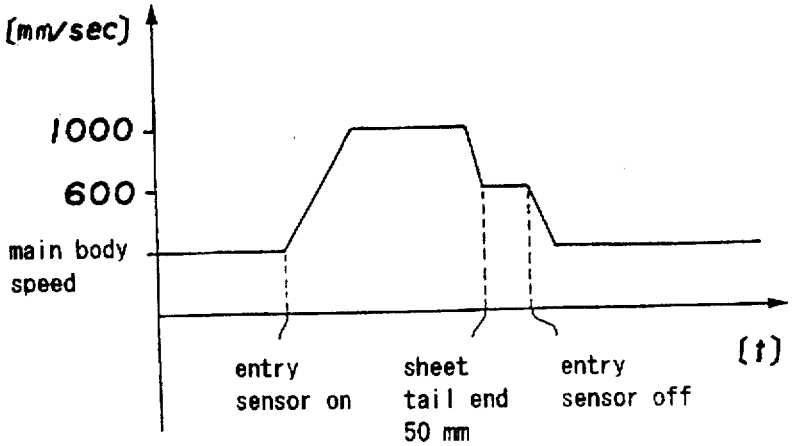
FIG. 8 is a timing diagram of a sheet discharging speed to the bin tray.

FIG. 8 is a timing diagram of a sheet discharging speed to the bin tray 12. The sheet conveyed from the sorter conveying part is discharged to the bin tray 12 by the bin discharging roller 21 which is driven independently by the bin discharging motor 30. The bin discharging speed of the bin discharging roller 21 is controlled to be approximately the same speed as the sorter conveying speed (e.g., a 0%–2% deviation in this embodiment) until the entry bin sensor (which includes a light emitting part 33 and a light accepting part 49) detects the tip portion of the sheet to be discharged into the bin tray 12. After the tip portion of the sheet is detected, the discharging speed is accelerated up to the speed of 1000 mm/sec. When a part of the sheet which is 50 mm from the tail end of the sheet reaches the bin discharging roller 21, the discharging speed decreases from 1000 mm/sec to 600 mm/sec, and the sheet is discharged to the bin tray 12 thereafter with a speed of 600 mm/sec. Finally, the sheet conveying speed slows down to the previous speed when the tail end of the sheet passes by the entry sensor.

Even though the sheet conveyer motor 15 is driven with a constant speed, the bin discharging motor 30 is rotatable at a variable speed for conveying the sheet because the sorter conveyer roller 20 which is driven by the sheet conveyer motor 15 is provided with a bearing which contains a one-way clutch. The sorter conveyer roller 20 is over-driven due to friction between the circumferential surface of the roller 20 and the sheet which is conveyed faster than the circumferential velocity of the roller 20 by the bin discharging roller 21, because the roller 20 idles forward by the one way clutch even though the roller 20 is engaged with the sheet conveyer motor 15.

The sheet discharging time becomes shorter by making the sheet discharging speed higher. Consequently, if the sheet discharging speed is made higher, an interval from a time when the sheet is finished to be discharged on the bin tray 12 to a time when a next sheet starts to be discharged on the bin tray 12 becomes longer. Therefore, if time for the bin lifting operation and the jogger operation is constant, the sheet post-processing apparatus 2 becomes applicable for processing a sheet at a higher CPM (copy per minute) speed than that of the image forming apparatus 1 to which the sheet post-processing apparatus 2 is connected. Further, if a required CPM speed is the same, the time for the bin lifting operation and the jogging operation can be set longer as a result. Therefore, low noise of the apparatus, reducing cost as a result of reducing a size of the bin lifting motor 26, and improving accuracy of sheet alignment can be realized. Further, the flying out of the sheet from the bin tray 12 is prevented and also the stacking of the sheets is improved by decreasing the bin discharging speed to 600 mm/sec.

The highest bin discharging speed is set to 1000 mm/sec in this embodiment. This speed is determined depending on the ability of the bin discharging motor 30, and influences the stacking of the sheet. However, the bin tray discharging speed must be equal to or higher than the sheet conveying speed of the sorter part so as to prevent paper jamming along the sheet conveying part, such as the sorter conveyer path 64, since paper jamming occurs due to bending of the sheet if the bin tray discharging speed is lower than the sheet conveying speed of the sorter part.

Still further, the sheet is discharged to the bin tray 12, with the reduced speed of 600 mm/sec after a part of the sheet which is 50 mm from the tail end of the sheet reaches the bin discharging roller 21 in this embodiment. The distance of the sheet from the tail end to the position for reducing the discharging speed is determined depending on the ability of the bin discharging motor 30, and the shorter the distance from the tail end of the sheet to the part for reducing the discharging speed becomes, the smoother the sheet is discharged to the bin tray 12. Although the bin discharging speed is set to 600 mm/sec in this embodiment, any speed in a range of 300 mm/sec through 700 mm/sec is applicable since proper stacking of the sheets is achieved with the bin discharging speed in that range.

When the punching mode is selected, the bin discharging speed is accelerated to 1000 mm/sec after the tail end of the sheet is passed through the punching unit 39 and the tip end of the sheet turns on the entrance sensor 35. The accuracy of the punching hole position is improved by punching under the slow conveying speed (an error of 1 mm may be caused by a timing error of 1 ms in a sheet conveying speed of 1000 mm/sec, while an error of 0.36 mm is caused by the timing error of 1 ms in a sheet conveying speed of 360 mm/sec).

Figure 9:
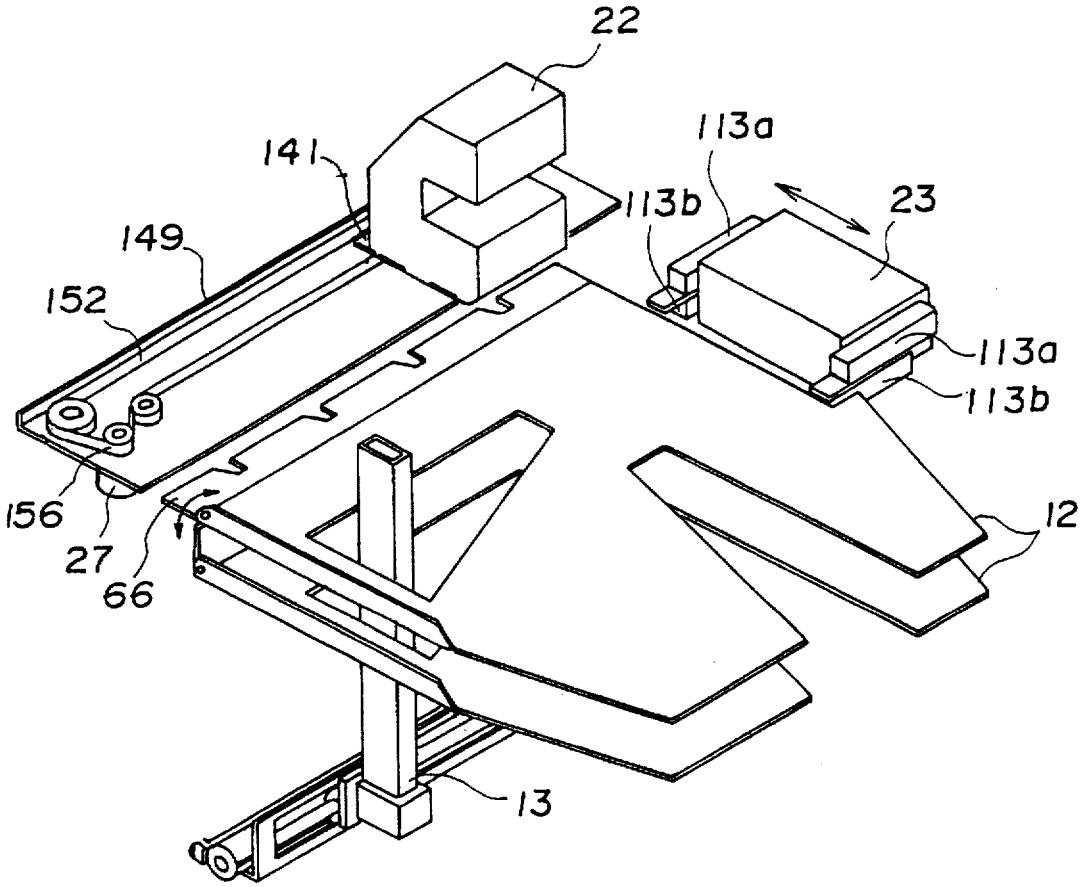
FIG. 9 is a perspective view showing a main part of the sheet post-processing apparatus.
Figure 10A:
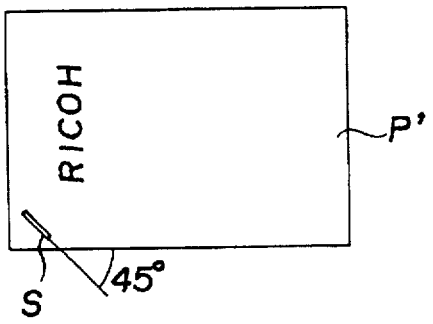
FIG. 10(*a*) to FIG. 10(*d*) are illustrations showing stapling positions.
Figure 10B:
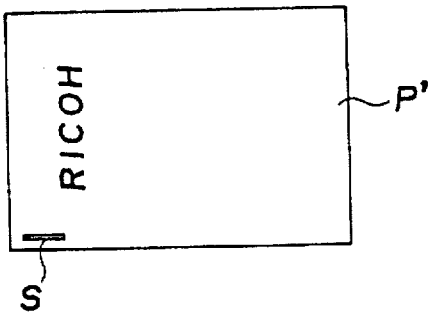
Figure 10C:
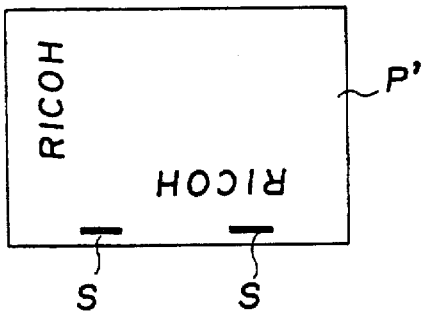
Figure 10D:
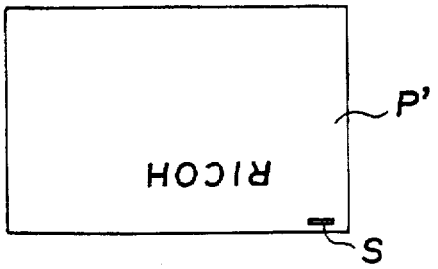

FIG. 9 is a perspective view showing a main part of the sheet post-processing apparatus 2 including the stapling unit 22, and FIG. 10(*a*) to FIG. 10(*d*) are illustrations showing stapling positions. A stapling unit 22 is mounted on the sheet post-processing apparatus 2, and the unit 22 is fixed to a moving member 141.

The moving member 141 is held for parallel movement along a groove (not shown) formed on a stay member 149. The stay member 149 having the groove is bent at approximately 45° at the front end part. Therefore, the moving member 141 moves parallel to an end face of the stacked set of the sheets P and is also able to rotate at approximately 45° near around the front end of the set of the sheets P so as to staple at a slant.

The moving member 141 is connected to a pulley 156 of the stapler transferring motor 21 through a member 152 including a timing belt, a pulley, an idler, and so on. The moving member 141 moves along the stay member 149 by a back-and-forth rotation of the stapler transferring motor 27, and the stapling unit 22 fixed on the moving member 141 also moves together.

Further, a home sensor (not shown) is mounted on the stay member 149, so that the stapling unit 22 is recognized to be at a home position when the moving member 141 reaches the sensor position. The stapling unit 22 is slanted at 45° to the sheet discharging direction, when the moving member 141 is at a slanting-home-sensor position (home position). If a stapling operation is executed at this position, the set of the sheets P' is stapled with a staple S at a position in FIG. 10(*a*), namely, stapled slantingly at a front side corner of the sheets. The moving member 141 moves from the home position along the end face of the set of the sheets in a direction indicated by an arrow by controlling the stapler transferring motor 27. When the stapling operation is executed by the stapling unit at a predetermined position, the set of the sheets is stapled with the staple S at a position as shown in FIGS. 10(*b*), 10(*c*) and 10(*d*) respectively. The stapling unit 22 is able to staple any number of staples at any position of a trailing end of the set of the sheets P' by controlling the stapler transferring motor 27.

The home position of the stapling unit 22 is the slanting stapling position, and the stapling unit 22 moves from the home position for a distance corresponding to a pulse count predetermined for each of the front position mode, the rear position mode, and the two center positions mode. The moving distance of the stapling unit 22 from the home position to the stapling position is the same for all sizes of the sheet for the front position mode, because in the front position mode, the stapling position is in the printed face side of the set of the sheets which are aligned by the jogger 13. For the rear position mode and the two center positions mode, the moving distance of the stapling unit 22 from the home position to the stapling position is different for differing sizes of sheets because f or the rear position mode, the stapling position is at the side of the set of the sheets which is tapped by the jogger 13, and for the two center positions mode, the stapling position is at the center part of each size of the sheet. This stapling position is determined in accordance with a selected mode and a sheet size.

Therefore, the moving distance of the stapling unit 22 from the home position to the position to staple the sheets is determined based upon the stapling position of the front position mode by adding a distance from the position to staple the sheets to the stapling position of the front position mode which is calculated for each sheet size in each stapling mode, to a distance from the stapling position of the front position mode to the home position.

By thus controlling the moving distance of the stapling unit for each stapling mode based upon the distance from the home position, the post-processing apparatus 2 need not adjust a stapling position of the rear position mode and the two center positions mode, m f a stapling position of the front position mode is adjusted correctly.

As the moving distance of the stapling unit 22 is linked to the distance of the staple S from a side edge of the set of the sheet, the sheet post-processing apparatus 2 is provided with an adjuster (not shown) for adjusting the moving distance of the stapling unit 22 in the front position mode approximately ±3.5 mm to calibrate an error of the stapling position due to unevenness of dimensions of mechanical parts and unevenness of assembling of the apparatus.

Figure 11:
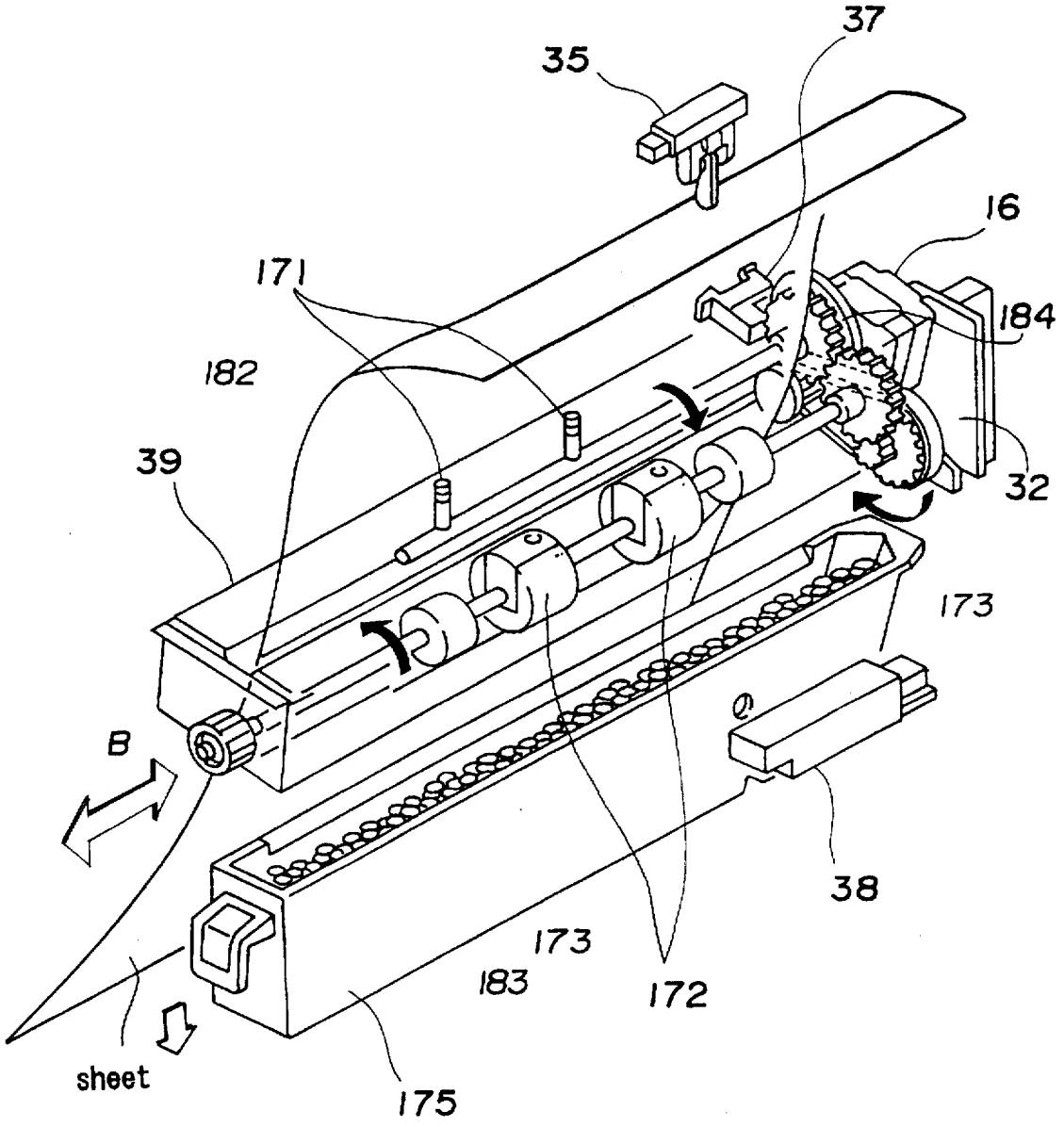
FIG. 11 is a perspective view showing a punching unit driving section of the present invention.
Figure 12:
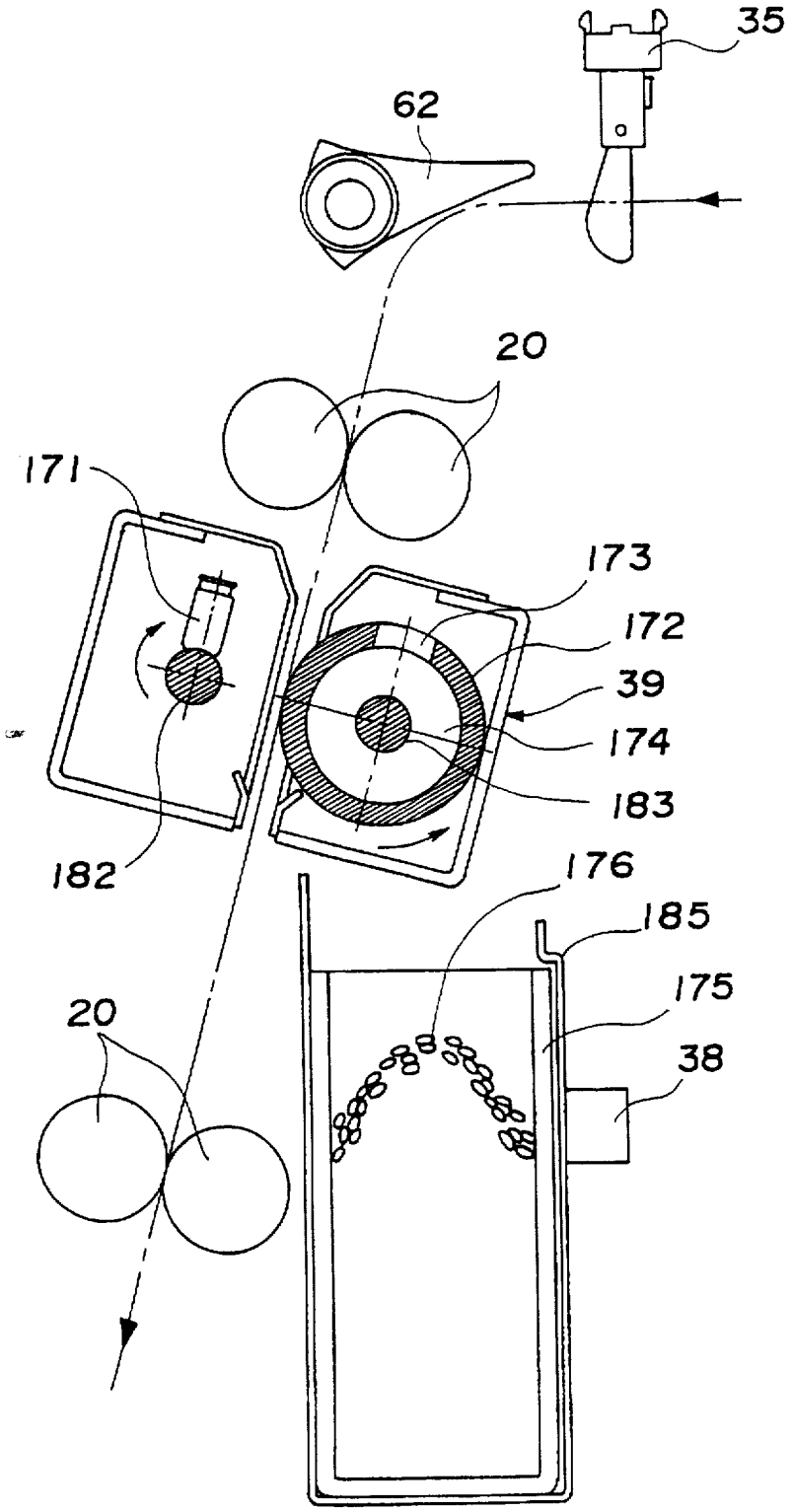
FIG. 12 is a partial cross sectional view centered around the punching unit of the present invention.
Figure 13:
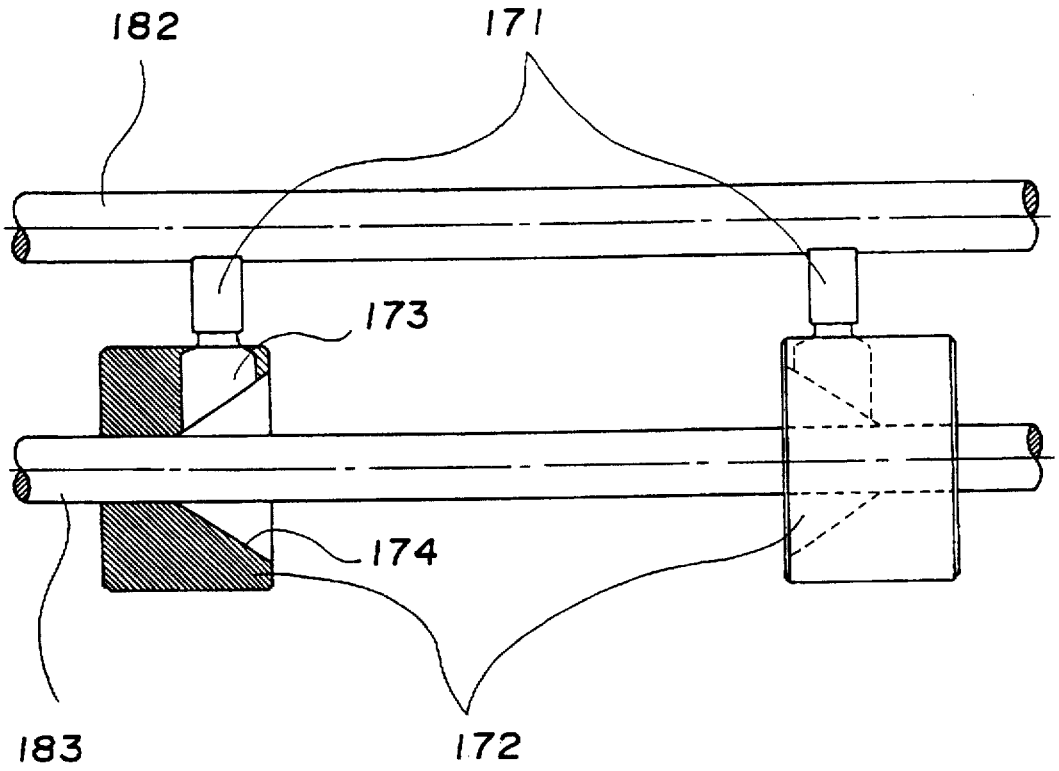
FIG. 13 is an elevation partly in section showing the die and the punch of the present invention.

FIG. 11 is a perspective view showing a punching unit driving section of the sheet post-processing apparatus 2 of the present invention, FIG. 12 is a partial cross sectional view centered around the punching unit of the present invention, and FIG. 13 is an elevation partly in section showing the dies and the punches of the punching unit in the present invention.

The construction around the punching unit 39 is shown in FIG. 11, and FIG. 12. The selecting guide pick 62, the sorter conveyer roller 20, the punching unit 39 and the sorter conveyer roller 20 are arranged in the sheet conveying order as shown in the drawings. Further, the entrance sensor 35 is also disposed nearby the upper stream of the sheet conveying course for the selecting guide pick 62.

The plurality of punches 171 mounted on a shaft 182 which is rotatable in a direction indicated by an arrow, a plurality of dies 172 mounted on a shaft 183 (as shown in FIG. 13 in detail) which is rotatable in a contrary direction to the shaft 182, the punching motor 16 to rotate the plurality of punches 171 and the plurality of dies 172 in a contrary direction to each other, and a punching PCB 32 for recognizing a sort of the punching unit 39 are disposed in the punching unit 39.

The plurality of punches 171 and the plurality of dies 172 are placed perpendicular to the sheet conveying direction, and are disposed facing with each other across the sheet conveying plane. Each die 172 is provided with a hole 173 and a tapered opening 174 which is connected to the hole 173 to guide the punch dust 176 (the waste in the shape of a circle and other paper waste) towards a punch dust container 175 which is placed just under the dies.

When the sheet is conveyed to the punching unit 39, and after a predetermined time from a time that the tail end of the sheet passes by the entrance sensor 35, the punching motor 16 is driven and the punch 171 and the die 172 rotate one time in the direction indicated by the arrow respectively synchronizing with each other, thereby engaging with each other.

The sheet conveyed into the punching unit 39 is conveyed between the punch 171 and the die 172, and the holes are punched at predetermined positions when the punch 171 and the die 172 are engaged according to the type of punching unit 39 being used. The sheet which is punched by the punching unit 39 is then conveyed to the bin discharging roller 21 by the sorter conveyer roller 20 and discharged onto the bin tray 12.

The aforementioned serial procedure is executed for each sheet which is discharged from the image forming apparatus 1. Further, the punch dust falls down to the hole 173 of the die 172 just after the sheet is punched, reaches the tapered opening 174 of the die 172, falls down from the internal surface of the die 172 to the punch dust container 175, and is held in the container 175.

The punching unit 39 is slidable into and out of the sheet post-processing apparatus 2 in a direction indicated by an arrow B in FIG. 11. Further, if the punching unit 39 is attached to the post-processing apparatus 2, the image forming apparatus 1 is brought to a state to recognize the type of the punching unit 39 from a punch code (punch information) which is set in the punching PCB 32 mounted on the rear part of the punching unit 39 for indicating the type of the punching unit 39. The image forming apparatus 1 recognizes the type of the punching unit 39 mounted on the sheet post processing apparatus 2, when an image forming operation is executed in the punching mode. The image forming apparatus 1 controls at least one of a sheet conveying speed, a punching speed, and a punch operation timing of the punching unit 39 in accordance with the type of the punching unit 39, and further controls the punching unit 39 to punch at a proper punching hole position according to the type of the punching unit 39. This hole position of the punch is predetermined for each type of the punching unit 39.

Figure 14:
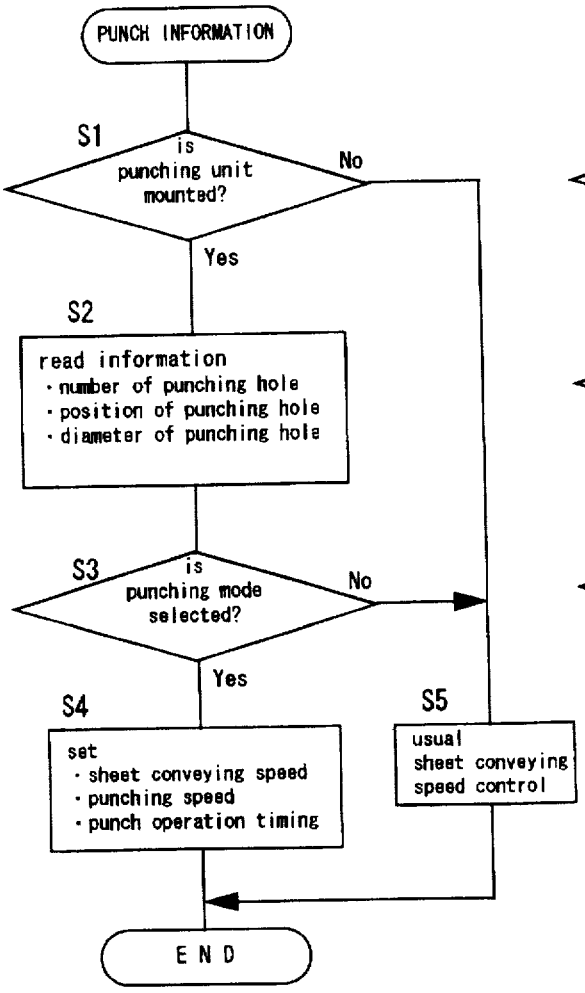
FIG. 14 is a flowchart explaining an operation of selecting a punching mode.

FIG. 14 is a flowchart showing an operation process pertaining to the punching of holes. A micro computer (hereinafter called a CPU) (not shown) which controls the image forming apparatus 1 is reset and starts a computer program. The CPU determines whether or not the punching unit is mounted on the sheet post-processing apparatus 2 in step S1. If the answer is YES in step S1, the CPU recognizes the type of the punching unit 39 from the code (punch information signal) which is set in the punching PCB 32 in step S2. Then, the CPU determines whether or not the punching mode is selected in step S3. If the answer is YES in step S3, the CPU sets the punching operation parameters in step S4 including at least one of a sheet conveying speed, a punching speed, and a punch operation timing of the punching unit in accordance with the type of the punching unit 39 which is recognized in step S2. The process then ends. When the CPU determines that the punching unit 39 is not mounted on the sheet post-processing apparatus 2 in step S1, or that the punching mode is not selected in step S3, the CPU executes a usual sheen conveying speed control at the sheet post-processing apparatus 2 in step S5 and the process ends.

Figure 15:
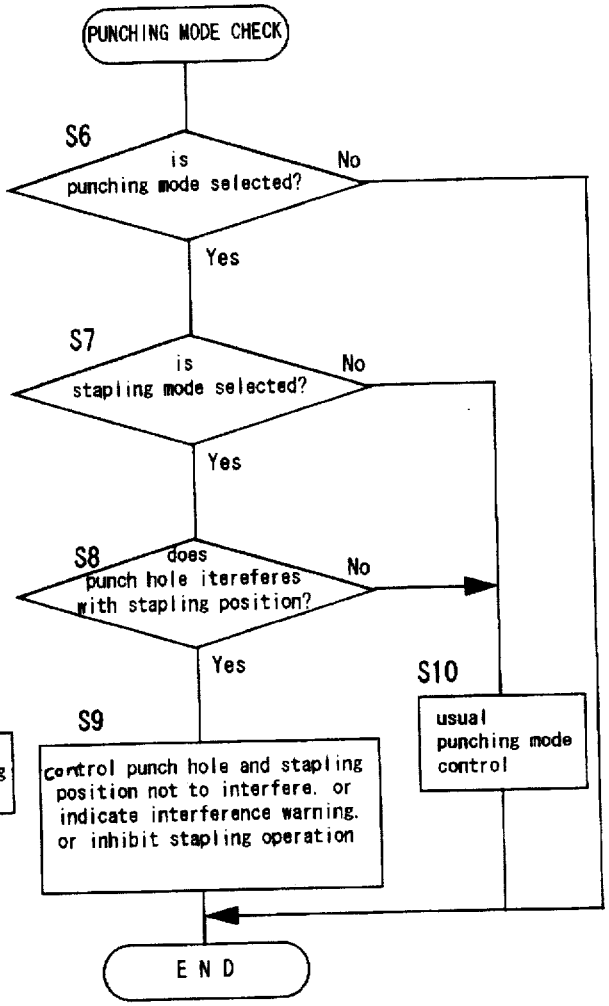
FIG. 15 is flowchart explaining an operation of selecting a punching mode and a stapling mode at the same time.

FIG. 15 is a flowchart showing a process in which the punching mode and the stapling mode can be utilized together. After starting, the CPU of the image forming apparatus 1 (not shown) determines in step S6 whether or not the punching mode is selected. If the answer is NO in step S6, the CPU ends the program. When the punching mode is selected, the CPU determines whether or not the stapling mode is selected in step S7. If the answer is YES in step S7, the CPU determines in step S8 whether or not the hole position of the punch for the sheet, which is determined by the punching unit 39 which is recognized by the recognition device, interferes with the stapling position in the sheet which is determined by a selected stapling mode and the sheet size. If the answer is YES in step S8, the CPU controls the stapling operation in step S9 to displace the stapling position to the sheet so that the punching position and the stapling position do not interfere with each other. The displacement of the stapling position is accomplished by moving the stapling unit, for example slightly in a direction perpendicular to a moving direction of the paper. Alternatively, to avoid a conflict with the punch position, the stapling unit can be moved in any other direction such as a direction parallel to the moving direction of the paper. Alternatively, the CPU indicates a warning in step S9 that the punching position interferes with the stapling position to an indicator in the operation unit 5 (not shown) in the image forming apparatus 1, and/or inhibits the stapling operation.

When the CPU determines that the stapling mode is not selected in step S7, or the CPU determines that the punching hole position and the stapling position do not interfere with each other in step S8, the CPU executes a usual punching mode in step S10, and the program then ends.

The application of the present invention is not limited only to the embodiment described herein, but the present invention is also applicable to a sheet processing apparatus of various types which utilize the technical idea of this invention. In particular, the punching unit 39 may be changed to any type having a punch and a die for punching holes to a sheet including, for example, a type which punches holes by a rectilinear motion of punches towards dies.

This invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patents of the United States is:

1. A sheet processing apparatus for processing a sheet comprising:

a punching unit detachably mounted on said apparatus for punching a sheet which is conveyed thereto;

recognition means for recognizing a type of said punching unit mounted on said apparatus; and control means for controlling a punching operation of said punching unit in accordance with the type of said punching unit which is recognized by said recognition means.

2. The sheet processing apparatus according to claim 1, wherein:

said control means controls at least one of a sheet conveying speed, a punching speed, and a punch operation timing of said punching unit depending upon the type of said punching unit which is recognized by said recognition means.

3. The sheet processing apparatus according to claim 1, wherein said punching unit comprises:

a punch and a die rotatable in directions opposite to each other; and a motor which rotates the punch and the die, and wherein said punching unit punches a sheet which is conveyed between the punch and the die at a predetermined position by rotating the punch and the die in directions which are opposite to each other by driving the motor at a predetermined timing, thereby inserting the punch into a hole of the die.

4. The sheet processing apparatus according to claim 2, wherein said punching unit comprises:

a punch and a die rotatable in directions opposite to each other; and a motor which rotates the punch and the die, and wherein said punching unit punches a sheet which is conveyed between the punch and the die at a predetermined position by rotating the punch and the die in directions which are opposite to each other by driving the motor at a predetermined timing, thereby inserting the punch into a hole of the die.

5. The sheet processing apparatus according to claim 1, further comprising:

a stapling unit for stapling a sheet which is conveyed thereto; and a warning indicator which warns an operator, wherein said control means comprises means for determining whether or not a punching position for the sheet interferes with a stapling position for the sheet in accordance with the type of said punching unit which is recognized by said recognition means, and means for controlling said warning indicator to indicate the warning when the punching position interferes with the stapling position.

6. The sheet processing apparatus according to claim 2, further comprising:

a stapling unit for stapling a sheet which is conveyed thereto; and a warning indicator which warns an operator, wherein said control means comprises means for determining whether or not a punching position for the sheet interferes with a stapling position for the sheet in accordance with the type of said punching unit which is recognized by said recognition means, and means for controlling said warning indicator to indicate the warning when the punching position interferes with the stapling position.

7. The sheet processing apparatus according to claim 3, further comprising:

a stapling unit for stapling the sheet which is conveyed thereto; and a warning indicator which warns an operator, wherein said control means comprises means for determining whether or not a punching position for the sheet interferes with a stapling position for the sheet in accordance with the type of said punching unit which is recognized by said recognition means, and means for controlling said warning indicator to indicate the warning when the punching position interferes with the stapling position.

8. The sheet processing apparatus according to claim 4, further comprising:

a stapling unit for stapling the sheet which is conveyed thereto; and a warning indicator which warns an operator, wherein said control means comprises means for determining whether or not a punching position for the sheet interferes with a stapling position for the sheet in accordance with the type of said punching unit which is recognized by said recognition means, and means for controlling said warning indicator to indicate the warning when the punching position interferes with the stapling position.

9. The sheet processing apparatus according to claim 1, further comprising:

a stapling unit for stapling the sheet which is conveyed thereto, wherein said control means comprises means for determining whether or not a punching position for the sheet interferes with a stapling position for the sheet in accordance with the type of said punching unit which is recognized by said recognition means, and means inhibiting a stapling operation of said stapling unit when the punching position interferes with the stapling position.

10. The sheet processing apparatus according to claim 2, further comprising:

a stapling unit for stapling the sheet which is conveyed thereto, wherein said control means comprises means for determining whether or not a punching position for the sheet interferes with a stapling position for the sheet in accordance with the type of said punching unit which is recognized by said recognition means, and means inhibiting a stapling operation of said stapling unit when the punching position interferes with the stapling position.

11. The sheet processing apparatus according to claim 3, wherein said control means comprises:

means for determining whether or not a punching position for the sheet interferes with a stapling position for the sheet in accordance with the result of recognizing the sort of said punching unit by said recognition means, and means for inhibiting a stapling operation of said stapling unit, when the punching position interferes with the stapling position.

12. The sheet processing apparatus according to claim 4, wherein said control means comprises:

means for determining whether or not a punching position for the sheet interferes with a stapling position for the sheet in accordance with the result of recognizing the sort of said punching unit by said recognition means, and means for inhibiting a stapling operation of said stapling unit, when the punching position interferes with the stapling position.

13. The sheet processing apparatus according to claim 5, wherein said control means comprises means for controlling a movement of said stapling unit when a stapling position interferes with a punch position, so that after stapling a staple by the stapling unit, the punch position does not overlap the staple.

14. The sheet processing apparatus according to claim 6, wherein said control means comprises means for controlling a movement of said stapling unit when a stapling position interferes with a punch position, so that after stapling a staple by the stapling unit, the punch position does not overlap the staple.

15. The sheet processing apparatus according to claim 7, wherein said control means comprises means for controlling a movement of said stapling unit when a stapling position interferes with the punch position, so that after stapling a staple by the stapling unit, the punch position does not overlap the staple.

16. The sheet processing apparatus according to claim 8, wherein said control means comprises means for controlling a movement of said stapling unit when a stapling position interferes with the punch position, so that after stapling a staple by the stapling unit, the punch position does not overlap the staple.

17. The sheet processing apparatus according to claim 1, wherein said recognition means recognizes the type of said punching unit based upon at least one of a number of holes punched by the punching unit, a diameter of the holes, and a punching position of said punching unit.

18. The sheet processing apparatus according to claim 2, wherein said recognition means recognizes the type of said punching unit based upon at least one of a number of holes punched by the punching unit, a diameter of the holes, and a punching position of said punching unit.

19. The sheet processing apparatus according to claim 1, wherein said recognition means performs the recognizing of the sort of said punching unit when said punching unit is mounted on said apparatus.

20. The sheet processing apparatus according to claim 2, wherein said recognition means performs the recognizing of the sort of said punching unit when said punching unit is mounted on said apparatus.

21. The sheet processing apparatus according to claim 17, wherein said recognition means performs the recognizing of the sort of said punching unit when said punching unit is mounted on said apparatus.

22. The sheet processing apparatus according to claim 18, wherein said recognition means performs the recognizing of the sort of said punching unit when said punching unit is mounted on said apparatus.

23. A method for punching a sheet with a sheet processing apparatus having a punching unit which is detachably mounted to said sheet processing apparatus, comprising the steps of:

recognizing a type of said punching unit which is mounted on said sheet processing apparatus; and punching the sheet at a position corresponding to a recognized type of said punching unit.

* * * * *